US011639636B2

(12) United States Patent
Hanson et al.

(10) Patent No.: US 11,639,636 B2
(45) Date of Patent: May 2, 2023

(54) DOWNHOLE TORQUE LIMITER

(71) Applicant: Halliburton Energy Services, Inc., Houston, TX (US)

(72) Inventors: Jon-Howard Elliott Hanson, Carrollton, TX (US); Richard Decena Ornelaz, Carrollton, TX (US); Michael Linley Fripp, Carrollton, TX (US); Gregory T. Werkheiser, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/335,492

(22) Filed: Jun. 1, 2021

(65) Prior Publication Data

US 2022/0381097 A1 Dec. 1, 2022

(51) Int. Cl.
*E21B 17/04* (2006.01)
*E21B 17/06* (2006.01)

(52) U.S. Cl.
CPC ..... *E21B 17/04* (2013.01); *E21B 17/06* (2013.01)

(58) Field of Classification Search
CPC ..... E21B 17/02; E21B 17/04; E21B 17/06; E21B 21/08
See application file for complete search history.

(56) References Cited

U.S. PATENT DOCUMENTS

| | | | | |
|---|---|---|---|---|
| 3,981,186 | A * | 9/1976 | Rauch | E21B 47/18 73/152.59 |
| 6,325,163 | B2 * | 12/2001 | Tibbitts | E21B 44/04 175/57 |
| 8,607,863 | B2 | 12/2013 | Fripp et al. | |
| 8,616,292 | B2 | 12/2013 | Knobloch, Jr. et al. | |
| 9,903,180 | B2 | 2/2018 | Boutin et al. | |
| 2004/0238219 | A1 * | 12/2004 | Nichols | E21B 17/07 175/320 |
| 2013/0056223 | A1 * | 3/2013 | Nichols | E21B 44/04 166/237 |
| 2014/0166370 | A1 | 6/2014 | D Silva | |
| 2016/0195087 | A1 | 7/2016 | Downtown | |
| 2017/0051562 | A1 | 2/2017 | Knobloch, Jr. et al. | |
| 2018/0252050 | A1 | 9/2018 | Veit et al. | |

FOREIGN PATENT DOCUMENTS

| | | | |
|---|---|---|---|
| JP | 0849485 | A | 2/1996 |
| WO | 2020112080 | A1 | 6/2020 |

* cited by examiner

*Primary Examiner* — Brad Harcourt
(74) *Attorney, Agent, or Firm* — Scott Richardson; Parker Justiss, P.C.

(57) ABSTRACT

Provided, in one aspect, is a downhole torque limiter, comprising a tubular housing; a pipe positioned within the tubular housing; one or more clutch mechanisms positioned between the pipe and the tubular housing, the one or more clutch mechanisms configured to move between a engaged state to fix the tubular housing relative to the pipe and a disengaged state to allow with the tubular housing to rotate relative to the pipe; and a fluid control system coupled with an exterior of the one or more clutch mechanisms, the fluid control system configured to allow the one or more clutch mechanisms to move from the engaged state to the disengaged state based upon sensing movement of the pipe relative to the tubular housing.

21 Claims, 8 Drawing Sheets

DOWNHOLE TORQUE LIMITER

BACKGROUND

A common problem encountered in drilling and servicing hydrocarbon wells is found when using an assembly of pipe sections which steps down in diameter to extend into a relatively smaller diameter borehole below the larger main casing section. For example, in a "drillstring," or sets of tubing called a tubing string, a reduced diameter drillpipe and their threaded connections have lower torque specifications than a larger diameter drillpipe it may be connected to. It may therefore be desirable to limit the magnitude of the torque transferred to the reduced diameter section of drillpipe to prevent damage to the smaller pipe. As used herein, the term "torque" is used to refer to the turning force applied to an object measured in force-distance units.

Traditional downhole torque limiting systems employ shear pins or other elements, which are designed to fail when a specified torque is exceeded, allowing the pipe sections to rotate with respect to each other. To reset these devices, the tubing string must be removed from the well and the fractured pin replaced, which is undesirable and expensive. Alternatively, a weight may be inserted into the wellbore to reset the pipe sections, which is undesirable for other reasons.

BRIEF DESCRIPTION

Reference is now made to the following descriptions taken in conjunction with the accompanying drawings, in which.

DETAILED DESCRIPTION

Figure 1:
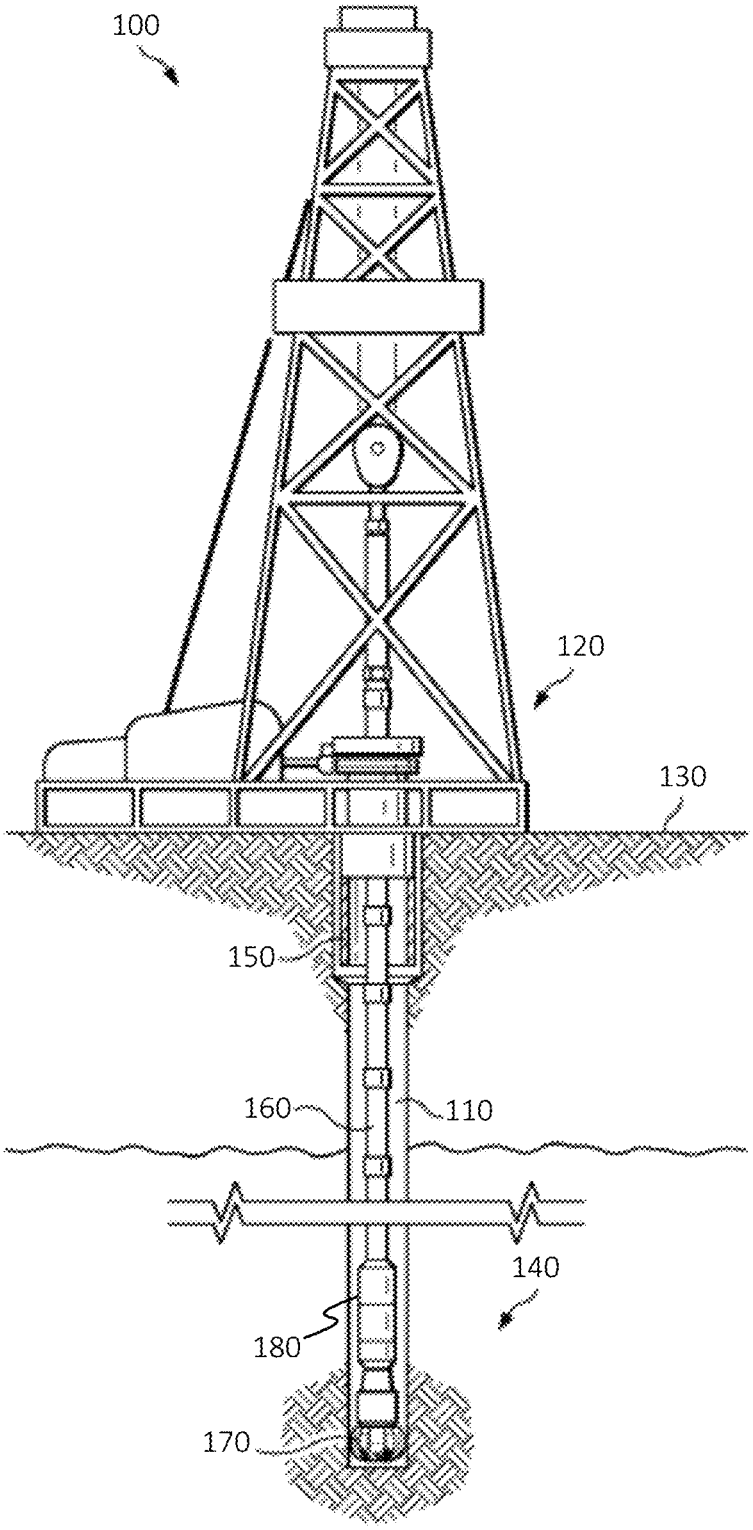
FIG. 1 illustrates a schematic partial cross-sectional view of an example well system for hydrocarbon reservoir production according to one or more embodiments disclosed herein.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

Referring now to FIG. 1, illustrated is a schematic partial cross-sectional view of an example well system 100 for hydrocarbon reservoir production, according to certain example embodiments. The well system 100, in one or more embodiments, generally includes a substantially cylindrical wellbore 110 extending from a wellhead 120 at the surface 130 downward into the Earth and into one or more subterranean zones of interest (one subterranean zone of interest 140 shown). The subterranean zone 140 can correspond to a single formation, a portion of a formation, or more than one formation accessed by the well system 100, and a given well system 100 can access one, or more than one, subterranean zone 140. After some or all of the wellbore 110 is drilled, a portion of the wellbore 110 extending from the wellhead 120 to the subterranean zone 140 may be lined with lengths of tubing, called casing 150. The depicted well system 100 is a vertical well, with the wellbore 110 extending substantially vertically from the surface 130 to the subterranean zone 140. The concepts herein, however, are applicable to many other different configurations of wells, including horizontal, slanted or otherwise deviated wells, and multilateral wells with legs deviating from an entry well.

A tubing string 160 is shown as having been lowered from the surface 130 into the wellbore 110. In some instances, the tubing string 160 may be a drillstring having a series of jointed lengths of tubing coupled together end-to-end and/or a continuous (e.g., not jointed) coiled tubing. The tubing string 160 may include one or more well tools, including a bottom hole assembly 170. The bottom hole assembly 170 can include, for example, a drill bit, a sand screen, a subsurface safety valve, a downhole sensor, an inflow control valve, a multilateral junction, a deflection wedge, or another type of production component. In the example shown, the wellbore 110 is being drilled. The wellbore 110 can be drilled in stages, and the casing 150 may be installed between stages. In some instances, the tubing string 160 is a completion string, a service string, coiled tubing, or another oilfield tubular. In one instance, the tubing string 160 is used to place a direction wedge for use in the construction of a multilateral junction.

In certain embodiments, there is a desire and/or need for a downhole torque limiter 180 associated with the tubing string 160. The downhole torque limiter 180, in some embodiments, may include a tubular housing and a pipe (e.g., mandrel, tubular, drill string, pup joint or any other oilfield tubular) positioned within the tubular housing. One or more clutch mechanisms may be positioned between the pipe and the tubular housing. The one or more clutch mechanisms may be configured to move between an engaged state (e.g., a radially engaged state in one embodiment) to fix the tubular housing relative to the pipe and a disengaged state (e.g., radially disengaged state in one embodiment) to allow with the tubular housing to rotate relative to the pipe. A fluid control system may be coupled with an exterior (e.g., radial exterior in one embodiment) side of the one or more clutch mechanisms, the fluid control system configured to allow the one or more clutch mechanisms to move from the engaged state to the disengaged state based upon sensing movement of the pipe relative to the tubular housing.

In some examples, the downhole torque limiter 180 may be set at a specified torque magnitude and then connected between a driver and a driven member, such as the tubing string 160 and the downhole assembly 170. The tubing string 160 may be placed in the wellbore 110 and rotated with the rotational force transmitted by the downhole torque limiter 180 until the specified torque is exceeded. When a pre-determined torque magnitude is reached, the tubing housing and pipe of the downhole torque limiter 180 will begin to rotate relative to one another, which will signal to the fluid control system to allow the one or more clutch mechanisms to move from the engaged state to the disengaged state. Accordingly, the one or more clutch mechanisms will disengage and slip to allow relative rotation between the tubing string 160 and the downhole assembly 170. The one or more clutch mechanisms may remain in the disengaged state until the rotation is stopped or at least the rotation rate is reduced. Once the rotation decreases, the downhole torque limiter 180 may reset without removing the tubing string 160 from the wellbore 110. When rotation recommences, the downhole torque limiter 180 may transmit rotational force up to the specified torque magnitude.

Figure 2:
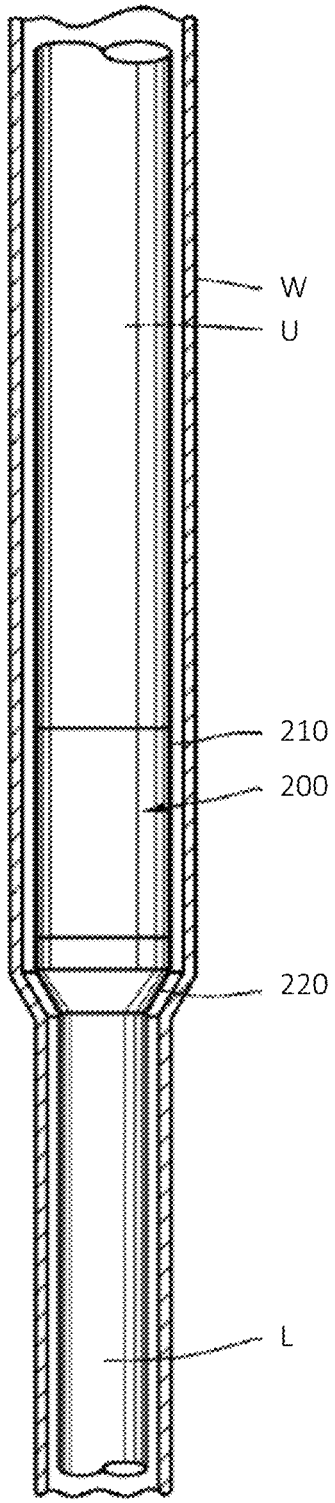
FIG. 2 illustrates one embodiment of a downhole torque limiter designed and manufactured according to one or more embodiments of the disclosure.

Turning to FIG. 2, illustrated is a downhole torque limiter 200 in its typical orientation connected in a tubing string located in the wellbore W. Tubing string section designated "U" is the upper section and the section designated "L" is the lower section. The term "tubing string" or "drill string" or "drill pipe" are used herein to refer to coil tubing, tubing, drill pipe or other tool deployment strings. While the example selected for explanation is tubing string, the torque limiter of the present invention can be used with tubing, casing, downhole tools, or any type of tubular members.

The downhole torque limiter 200 has an upper driver end 210 and a lower driven end 220. Typically, upper driver end 210 and lower driven end 220 have threaded connections for making up the downhole torque limiter 200 within a tubing string, for example, a drill string. A central bore B (not shown in FIG. 2) extends the length of the downhole torque limiter 200, to permit fluids to be pumped through the tool and down the tubing string.

Upper driver end 210, in one or more embodiments, is connected to upper section U by a threaded connection. In the illustrated example, the upper section U is connected to the surface rig and can be raised, lowered, and rotated thereby. Lower driven end 220 is connected to the reduced diameter lower section L. As is typical, a smaller diameter wellbore casing can be present, necessitating the use of the reduced diameter lower section L to access the smaller diameter wellbore casing. In the illustrated embodiment, the downhole torque limiter 200 connects upper U and lower L sections together and transmits rotational movement and torque to lower section L.

As will be explained in detail, the downhole torque limiter 200 can be set up to allow the upper driver end 210 and the lower driven end 220 to slip with respect to each other when the magnitude of the torque applied to downhole torque limiter 200 exceeds the preset limit. Thus, when the torque applied by an uphole rig while rotating upper section U exceeds a specified limit, the downhole torque limiter 200 will allow the upper driver end 210 and the lower driven end 220 to slip. According to a particular feature of the present invention, when rotation of the upper driver end 210 ceases or is reduced, the downhole torque limiter 200 will reset to condition where the ends no longer slip with respect to each other, and rotational movement and torque will be transferred to lower section L.

Figure 3:
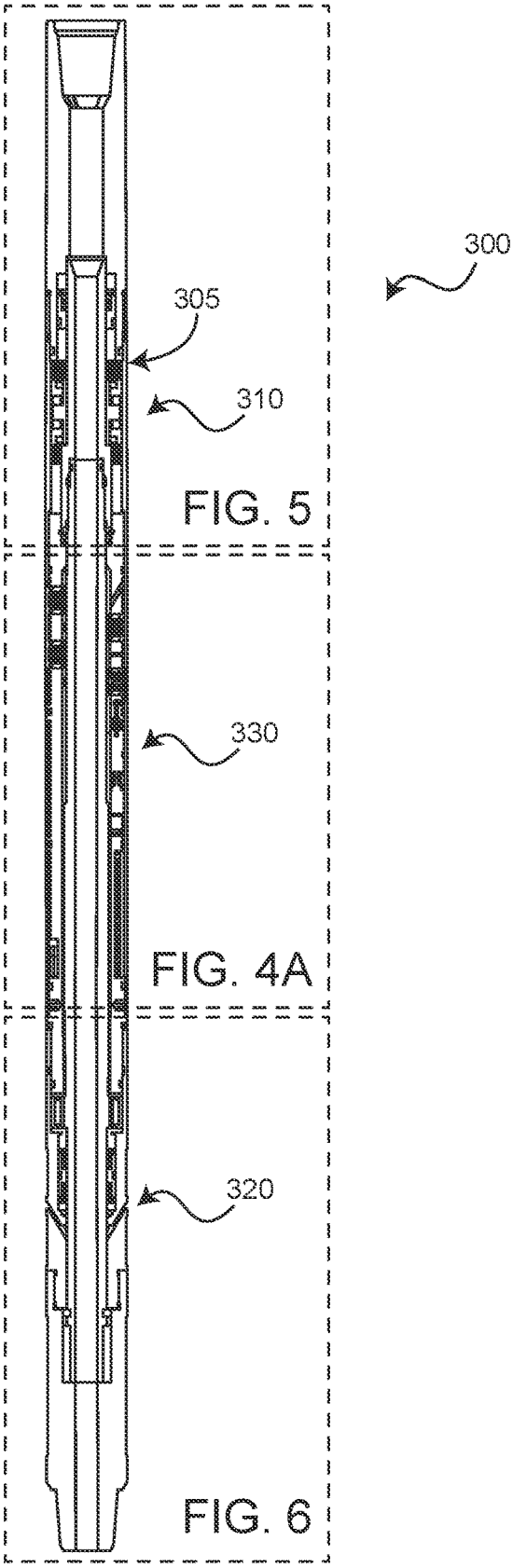
FIG. 3 is a section view of a downhole torque limiter designed and manufactured according to one or more embodiments of the disclosure.

Referring now to FIG. 3, there is shown a section view of a downhole torque limiter 300 designed and manufactured according to one or more embodiments of the disclosure. The downhole torque limiter 300 includes a tubular housing 305 having an upper driver end 310, shown in more detail in FIG. 5; and a lower driven end 320, shown in more detail in FIG. 6, and a center portion 330, shown in more detail in FIGS. 4A through 4C.

Figure 4A:
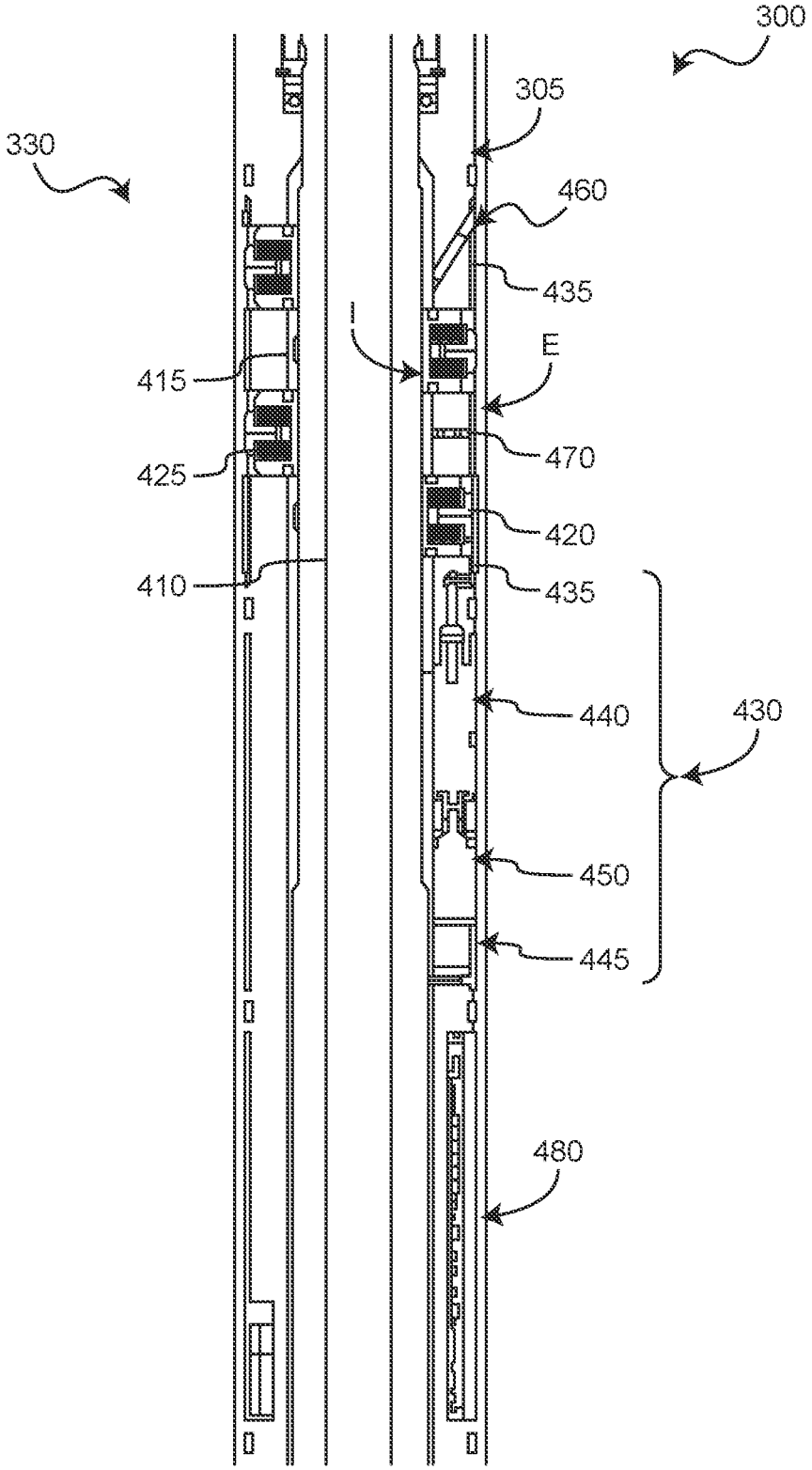
FIG. 4A is a section view of a center portion of the torque limiter shown in FIG. 3, shown in an engaged state.
Figure 4B:
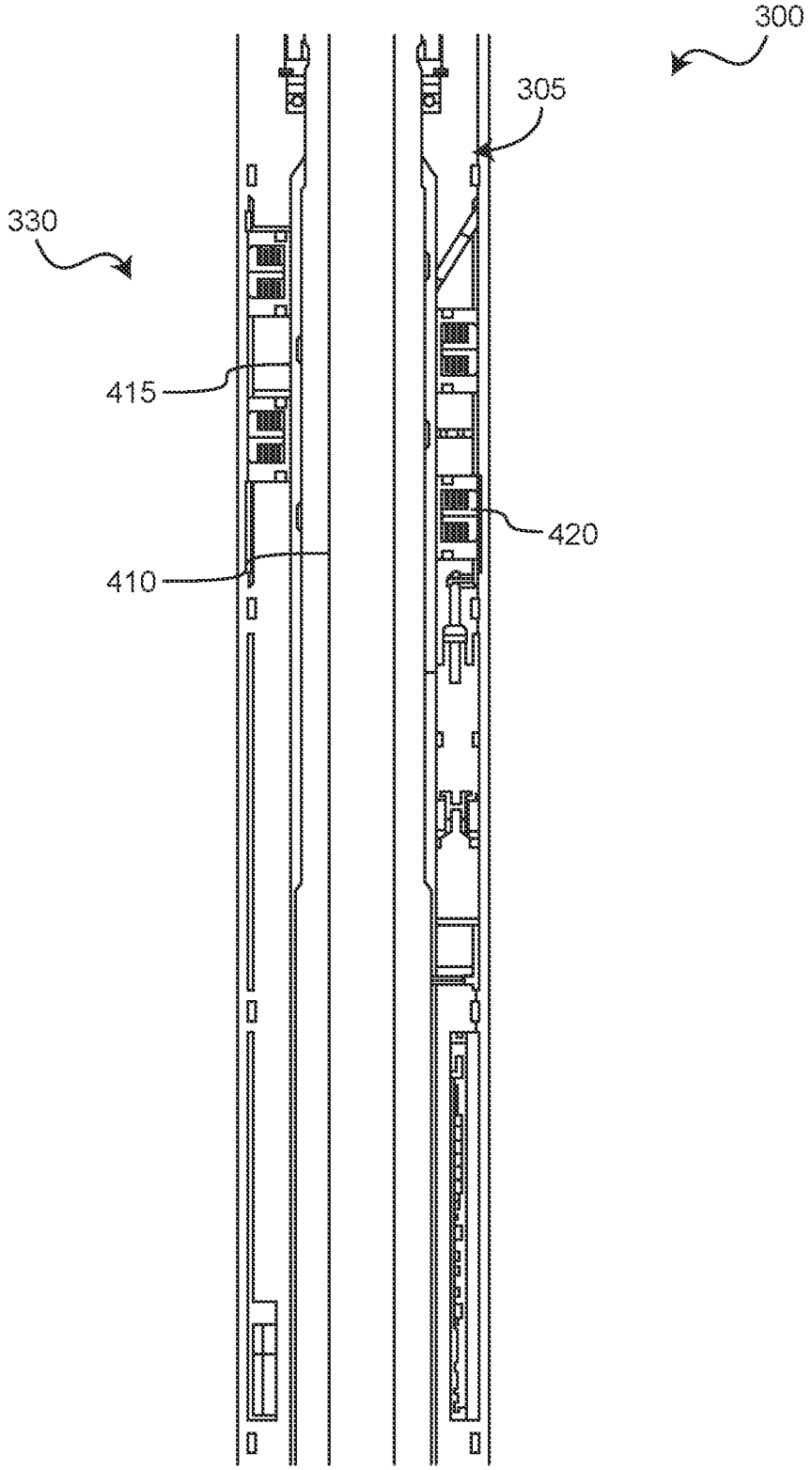
FIG. 4B is a section view of the center portion of the torque limiter shown in FIG. 3, shown in a disengaged state.

Referring now to FIG. 4A, there is shown the center portion 330 of one embodiment of the downhole torque limiter 300. The downhole torque limiter 300, in this embodiment, may include a pipe 410 positioned within the tubular housing 305. One or more clutch mechanisms, which in some embodiments may be piston assemblies 420, may be positioned between the pipe 410 and the tubular housing 305. The piston assemblies 420 may be configured to move between an engaged state, as shown in FIG. 4A, and a disengaged state, as shown in FIG. 4B. When the piston assemblies 420 are in an engaged state, the tubular housing 305 may be fixed relative to the pipe 410. When the piston assemblies 420 are in a disengaged state, the tubular housing 305 may rotate relative to the pipe 410.

The downhole torque limiter 300 may include a fluid control system 430 fluidly coupled with an exterior E (e.g., radial exterior in one embodiment) of the piston assemblies 420, which may include one or more fluid chambers 435. The fluid control system 430 may be configured to allow the piston assemblies 420 to move from the engaged state to the disengaged state based upon sensing movement of the pipe 410 relative to the tubular housing 305. In the illustrated embodiment, the fluid control system 430 may include electronics 480 configured to sense movement of the pipe 410 relative to the tubular housing 305 and send a signal to the fluid control system 430 to regulate the fluid pressure in the exterior E, and thus allow or disallow relative movement.

In some embodiments, the piston assemblies 420 may be hydraulic pistons and fluid pressure in the exterior E may maintain the piston assemblies 420 in an engaged state with the pipe 410. In the illustrated embodiment, the piston assemblies 420 may further include a spring 425, which itself may resist a certain amount of torque between the tubular housing 305 and the pipe 410, such that the piston assemblies 420 remain engaged with the pipe 410.

The fluid control system 430 may include a hydraulic pump 440 in fluid connection with the exterior E, wherein the hydraulic pump 440 may be configured to control fluid pressure in the exterior E. In certain embodiments, the hydraulic pump 440 may further include a motor 445 and associated gearbox 450.

As shown in FIG. 4A, the hydraulic pump 440 may control fluid pressure in the exterior E. As a pre-set torque value is reached, the hydraulic pump 440 may reduce fluid pressure in the exterior E such that the piston assemblies 420 may move at least partially from the fully engaged state shown in FIG. 4A. In at least one embodiment, the pre-set torque value is between 100 ft-lbs. and 100,000 ft-lbs. In yet another embodiment, the pre-set torque value is between 500 ft-lbs. and 5000 ft-lbs. When the piston assemblies 420 are in a fully engaged state, the piston assemblies 420 may fully engage the pipe 410. However, under certain conditions, the piston assemblies 420 may remain partially engaged such that the piston assemblies 420 may still engage protrusions 415 positioned about the pipe 410 and as such, the tubular housing 305 may, in some embodiments, be able to partially rotate with the pipe 410. The torque limit can be adjusted, in one or more embodiments, by adjusting the amount of fluid that is pumped by the hydraulic pump 440.

Referring to FIG. 4B, at another operational condition, the lower tool is engaged, and further rotation would exceed the torque limit. In this operational condition, the hydraulic pump 440 may suction the fluid from the exterior E such that the piston assemblies 420 are moved to a substantially disengaged state from the pipe 410. As described herein, when the piston assemblies 420 are in the substantially disengaged state, the piston assemblies 420 may rotate freely with respect to the protrusions 415 and the pipe 410, and thus there is no contact between the piston assemblies 420 and the protrusions 415.

Referring back to FIG. 4A, in some embodiments, the downhole torque limiter 300 may include a pressure relief valve 460. The pressure relief valve 460, in some embodiments, may be configured to allow fluid from the exterior E of the piston assemblies 420 to move to an interior I (e.g., radial interior in one embodiment) of the of the piston assemblies 420 upon failure of the fluid control system 430 and sensing a high-pressure situation. In at least one embodiment, a high-pressure situation is a pressure situation that is at least 100 psi greater than the hydrostatic downhole pressure. In at least one other embodiment, a high-pressure situation is a pressure situation that is at least 1,000 psi greater than the hydrostatic downhole pressure. In yet another embodiment, the high-pressure situation is a pressure situation ranging from about 100 psi to about 10,000 psi greater than the hydrostatic downhole pressure. The fluid may, in some embodiments, move within the fluid chambers 435 in an uphole direction from the piston assemblies 420 and through the pressure relief valve 460. In other embodiments, the downhole torque limiter 300 may further include a one-way check valve 470 configured to allow fluid to move from the disengaged interior I of the piston assemblies 420 to the exterior E of the piston assemblies 420 when the high-pressure situation has been relieved. Thus, the piston assemblies 420 may then move back at least partially into the engaged state with the pipe 410.

Figure 4C:
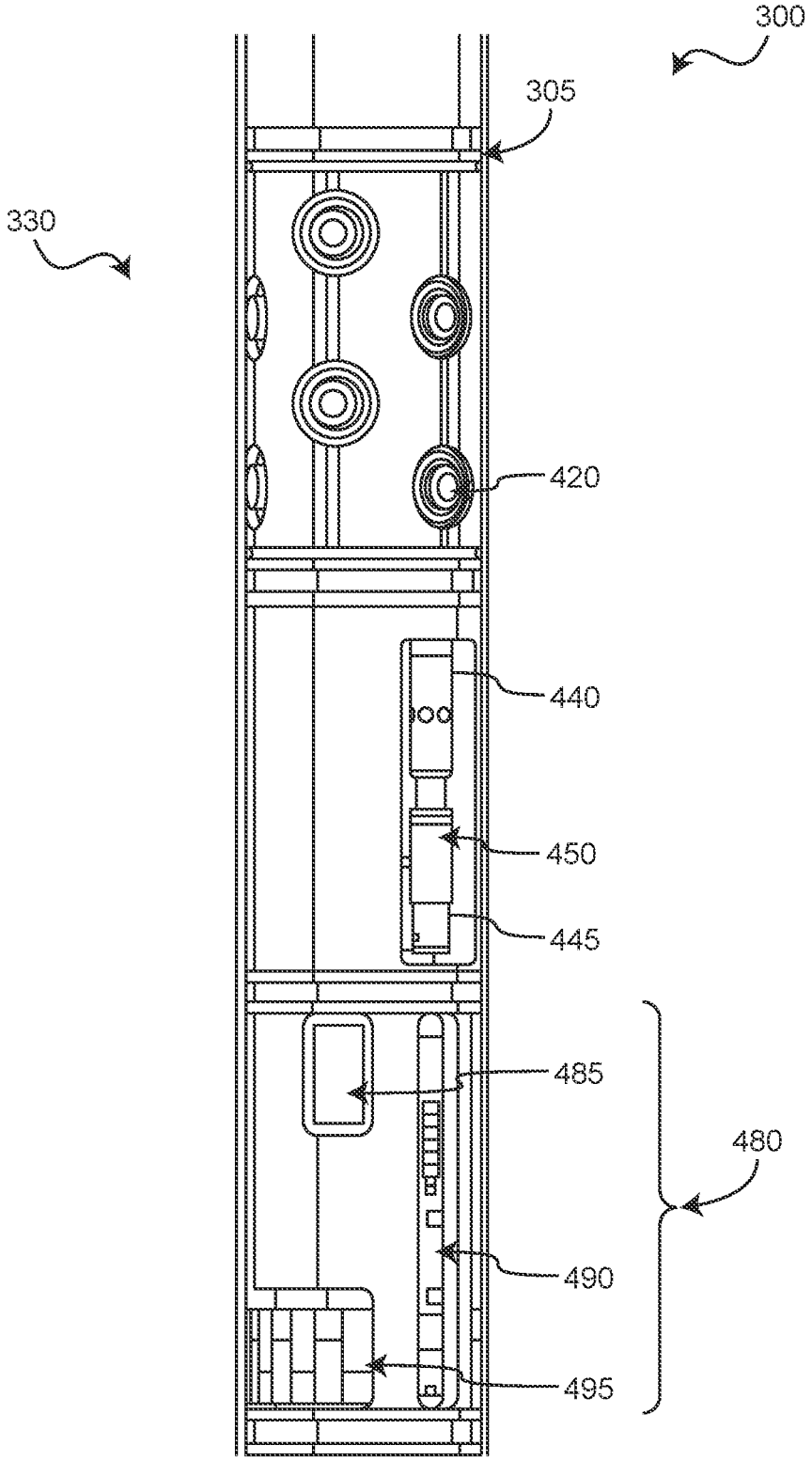
FIG. 4C is an external view of the center portion of the torque limiter shown in FIG. 3.

Turning now to FIG. 4C, in some embodiments, upon sensing a certain amount of movement and, in some examples, vibration of the pipe, the electronics 480 may send a signal to the hydraulic pump 440, whereafter the hydraulic pump 440 may adjust the fluid pressure in the exterior E according to the amount of movement. In some embodiments, the electronics 480 may include a sensor 485 which is configured to sense the movement and/or vibration of the pipe 410. The sensor 485, in at least one embodiment, is an acoustic sensor or a magnetic sensor. In at least one embodiment, the acoustic sensor could be a piezoelectric sensor, an accelerometer, a microphone, a ferroelectric sensor, a strain gauge, a pressure sensor, among others. The electronics 480 may also include a controller and a power supply, which in some embodiments may be a circuit board assembly 490 and one or more batteries 495. The circuit board assembly 490 may connect with the hydraulic pump 440, motor 445, and the gearbox 450.

Figure 5:
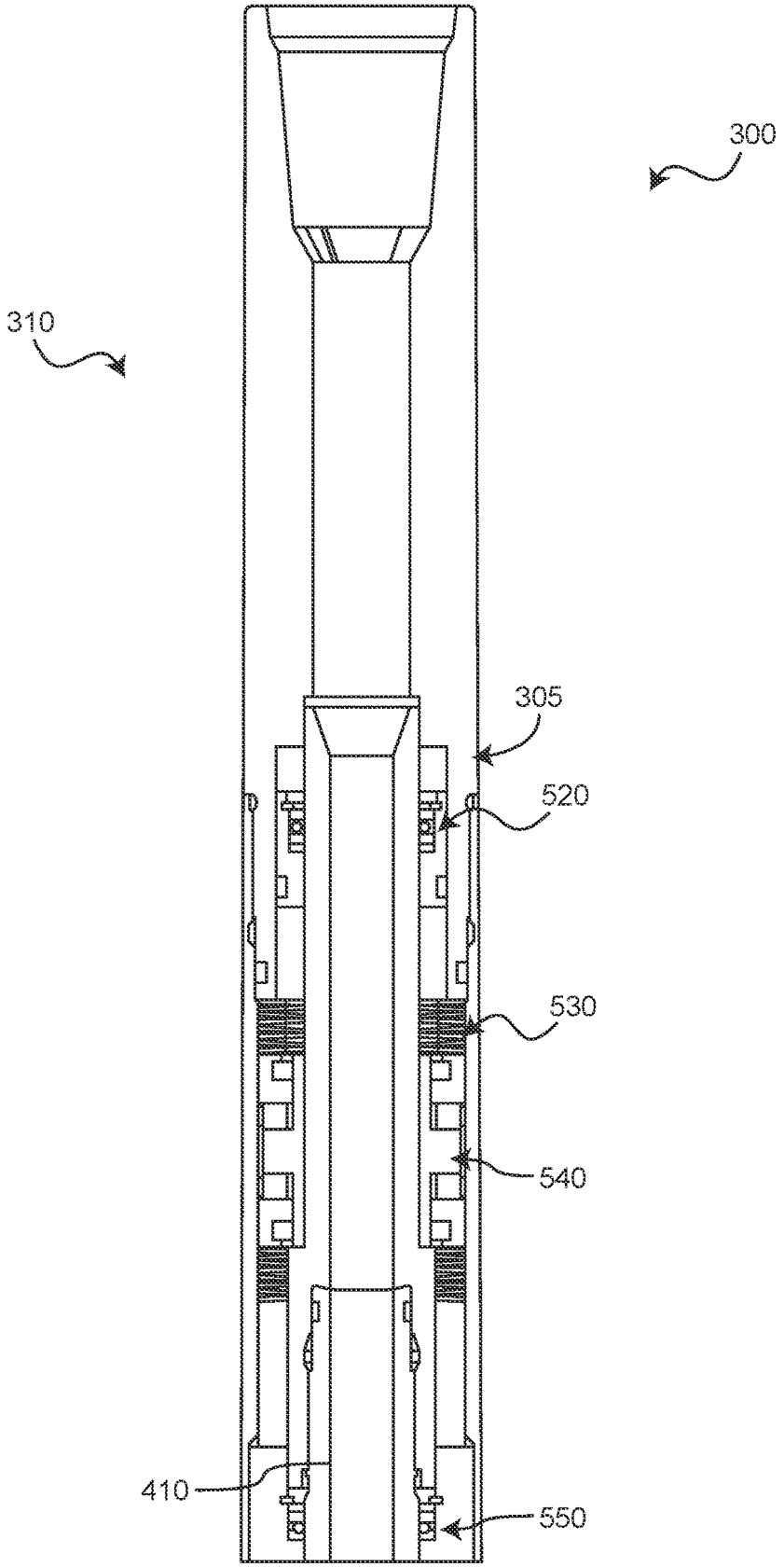
FIG. 5 is a section view of an upper driver end of the torque limiter shown in FIG. 3.

Turning now to FIG. 5, there is shown the upper driver end 310 of the housing 305. In some embodiments, the upper driver end 310 may, be fixed with respect to the pipe 410. In the illustrated embodiment, the upper driver end 310 may include various components which may work in conjunction with the hydraulic pump system 430 and support rotation of the housing 305. For example, the upper driver end may include a balance piston 520, pre-load springs 530, and bearings 540, which may include both radial and thrust bearings. The upper driver end 310 may also include a rotary seal 550, which may provide a seal about an upper end of the pipe 410.

Figure 6:
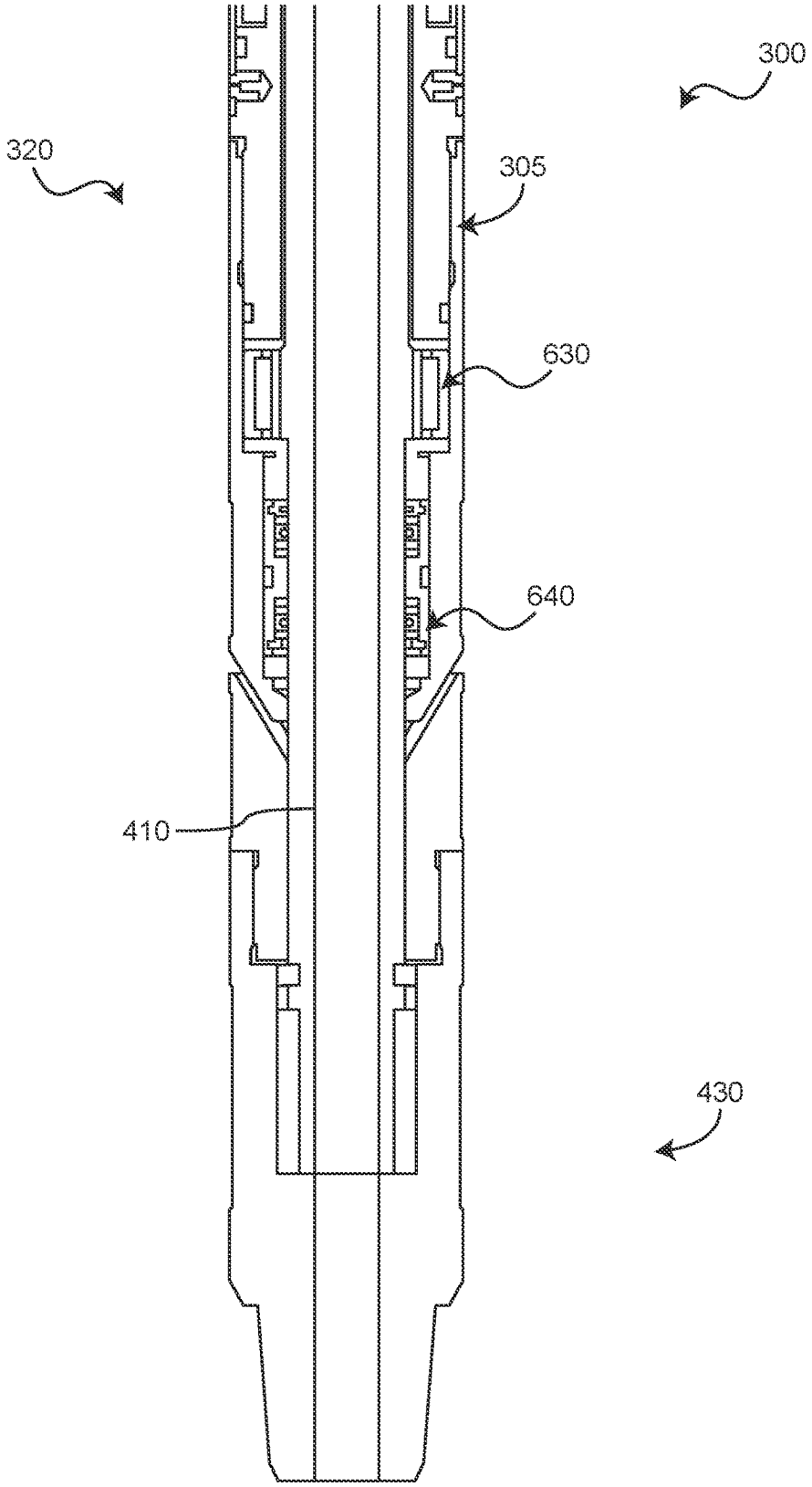
FIG. 6 is a section view of a lower driven end of the torque limiter shown in FIG. 3.

Turning now to FIG. 6, there is shown the lower driven end 320 of the housing 305. The lower driven end 320, in this embodiment may engage and disengage with the pipe 410 for rotation therewith. In some embodiments, the lower driven end 320 may include additional features which may work in conjunction with the hydraulic pump system 430 and support rotation of the lower driven end 320. The lower driven end 320 may include a radial bearing 630 positioned about the pipe 410 and a balance piston 640.

Other embodiments of a downhole torque limiter may utilize other components in conjunction with or in place of certain components disclosed herein. For example, other embodiments of a downhole torque limiter may utilize a solenoid valve and pump. In other embodiments, a downhole torque limiter may utilize a generator to supply power to embodiments of the electronics 480, wherein the generator may be driven by relative rotation of the pipe and housing. In yet other embodiments, the downhole torque limiter may use relative rotation within the downhole torque limiter to drive a mechanical pump for controlling fluid exterior to the one or more clutch mechanisms.

Aspects disclosed herein include:

A. A downhole torque limiter, the downhole torque limiter including: 1) a tubular housing; 2) a pipe positioned within the tubular housing; 3) one or more clutch mechanisms positioned between the pipe and the tubular housing, the one or more clutch mechanisms configured to move between a engaged state to fix the tubular housing relative to the pipe and a disengaged state to allow with the tubular housing to rotate relative to the pipe; and 4) a fluid control system coupled with an exterior of the one or more clutch mechanisms, the fluid control system configured to allow the one or more clutch mechanisms to move from the engaged state to the disengaged state based upon sensing movement of the pipe relative to the tubular housing.

B. A well system, the well system including: 1) a wellbore; 2) a tubing string positioned within the wellbore; 3) a torque limiter coupled with the tubing string, the torque limiter including: a) a tubular housing; b) a pipe positioned within the tubular housing; c) one or more clutch mechanisms positioned between the pipe and the tubular housing, the one or more clutch mechanisms configured to move between a engaged state to fix the tubular housing relative to the pipe and a disengaged state to allow with the tubular housing to rotate relative to the pipe; and d) a fluid control system coupled with an exterior of the one or more clutch mechanisms, the fluid control system configured to allow the one or more clutch mechanisms to move from the engaged state to the disengaged state based upon sensing movement of the pipe relative to the tubular housing.

C. A method for limiting torque in a well system, the method including: 1) running a downhole torque limiter into a wellbore, the downhole torque limiter coupled with at least a tubing string and including: a) a tubular housing; b) a pipe positioned within the tubular housing; c) one or more clutch mechanisms positioned between the pipe and the tubular housing, the one or more clutch mechanisms configured to move between a engaged state to fix the tubular housing relative to the pipe and a disengaged state to allow with the tubular housing to rotate relative to the pipe; and d) a fluid control system coupled with a exterior of the one or more clutch mechanisms, the fluid control system configured to allow the one or more clutch mechanisms to move between the engaged state to the disengaged state; e) wherein the fluid control system includes electronics configured to sense movement of the pipe relative to the tubular housing and send a signal to a hydraulic pump of the fluid control system; 2) sensing movement of the pipe relative to the tubular housing using the electronics; 3) sending a signal to the hydraulic pump to control fluid against a exterior of the one or more clutch mechanisms; and 4) controlling fluid against the exterior of the one or more clutch mechanisms to allow the one or more clutch mechanisms to move from the engaged state to the disengaged state.

Aspects A, B, and C may have one or more of the following additional elements in combination: Element 1: wherein each of the one or more clutch mechanisms includes a piston assembly. Element 2: wherein the piston assembly is held in the engaged state by fluid pressure against the exterior of the piston assembly. Element 3: wherein the piston assembly includes a spring, wherein the piston assembly is held in the engaged state by the spring. Element 4: wherein the fluid control system includes a hydraulic pump configured to control fluid pressure against the exterior of the one or more clutch mechanisms. Element 5: wherein the hydraulic pump reduces the fluid pressure against the exterior of the one or more clutch mechanisms to allow the one or more clutch mechanisms to move at least partially from the engaged state to the disengaged state. Element 6: wherein the hydraulic pump suctions the fluid from the exterior of the one or more clutch mechanisms to move the one or more clutch mechanisms to a substantially disengaged state. Element 7: further including a pressure relief valve configured to allow fluid from the exterior of the one or more clutch mechanisms to move to an interior of the of the one or more clutch mechanisms upon failure of the fluid control system and sensing a high-pressure situation. Element 8: further including a one-way check valve configured to allow fluid to move from the interior of the one or more clutch mechanisms to the exterior of one or more clutch mechanisms when the high-pressure situation has been relieved. Element 9: wherein the fluid control system includes electronics configured to sense movement of the pipe relative to the tubular housing and send a signal to a hydraulic pump of the fluid control system to allow the one or more clutch mechanisms to move from the engaged state to the disengaged state. Element 10: wherein the electronics includes an acoustic sensor configured to sense the movement of the pipe. Element 11: wherein the tubular housing includes an upper driver end and a lower driven end, wherein the upper driver end is fixed with respect to the pipe and the lower driven end engages and disengages with the pipe. Element 12: further including: a pressure relief valve configured to allow fluid from the exterior of the one or more clutch mechanisms to move to a disengaged interior of the of the one or more clutch mechanisms upon failure of the fluid control system and sensing a high-pressure situation; and a one-way check valve configured to allow fluid to move from the disengaged interior of the one or more clutch mechanisms to the exterior of one or more clutch mechanisms when the high-pressure situation has been relieved. Element 13: wherein the fluid control system includes electronics configured to sense movement of the pipe relative to the tubular housing and send a signal to a hydraulic pump of the fluid control system to allow the one or more clutch mechanisms to move from the engaged state to the disengaged state. Element 14: wherein the wherein the tubing string is a drillstring and wherein the tubular housing includes an upper driver end and a lower driven end, wherein the upper driver end is coupled with the drillstring and fixed with respect to the pipe and the lower driven end engages and disengages with the pipe. Element 15: further including a pressure relief valve configured to allow fluid from the exterior of the one or more clutch mechanisms to move to a disengaged interior of the of the one or more clutch mechanisms upon failure of the fluid control system and sensing a high-pressure situation. Element 16: further including a one-way check valve configured to allow fluid to move from the disengaged interior of the one or more clutch mechanisms to the exterior of one or more clutch mechanisms when the high-pressure situation has been relieved.

Those skilled in the art to which this application relates will appreciate that other and further additions, deletions, substitutions, and modifications may be made to the described embodiments.

What is claimed is:

1. A downhole torque limiter, comprising:

a tubular housing;

a pipe positioned within the tubular housing;

one or more clutch mechanisms positioned between the pipe and the tubular housing, the one or more clutch mechanisms configured to move between an engaged state to fix the tubular housing relative to the pipe and a disengaged state to allow with the tubular housing to rotate relative to the pipe; and a fluid control system coupled with an exterior of the one or more clutch mechanisms, the fluid control system configured to allow the one or more clutch mechanisms to move from the engaged state to the disengaged state based upon sensing movement of the pipe relative to the tubular housing, wherein the fluid control system includes a hydraulic pump configured to control fluid pressure against the exterior of the one or more clutch mechanisms.

2. The downhole torque limiter according to claim 1, wherein each of the one or more clutch mechanisms includes a piston assembly.

3. The downhole torque limiter according to claim 2, wherein the piston assembly is held in the engaged state by fluid pressure against the exterior of the piston assembly.

4. The downhole torque limiter according to claim 3, wherein the piston assembly includes a spring, wherein the piston assembly is held in the engaged state by the spring.

5. The downhole torque limiter according to claim 1, wherein the hydraulic pump reduces the fluid pressure against the exterior of the one or more clutch mechanisms to allow the one or more clutch mechanisms to move at least partially from the engaged state to the disengaged state.

6. The downhole torque limiter according to claim 1, wherein the hydraulic pump suctions the fluid from the exterior of the one or more clutch mechanisms to move the one or more clutch mechanisms to a substantially disengaged state.

7. The downhole torque limiter according to claim 1, further including a pressure relief valve configured to allow fluid from the exterior of the one or more clutch mechanisms to move to an interior of the of the one or more clutch mechanisms upon failure of the fluid control system and sensing a high-pressure situation.

8. The downhole torque limiter according to claim 7, further including a one-way check valve configured to allow fluid to move from the interior of the one or more clutch mechanisms to the exterior of one or more clutch mechanisms when the high-pressure situation has been relieved.

9. The downhole torque limiter according to claim 1, wherein the fluid control system includes electronics configured to sense movement of the pipe relative to the tubular housing and send a signal to a hydraulic pump of the fluid control system to allow the one or more clutch mechanisms to move from the engaged state to the disengaged state.

10. The downhole torque limiter according to claim 9, wherein the electronics includes an acoustic sensor configured to sense the movement of the pipe.

11. The downhole torque limiter according to claim 1, wherein the tubular housing includes an upper driver end and a lower driven end, wherein the upper driver end is fixed with respect to the pipe and the lower driven end engages and disengages with the pipe.

12. A well system, comprising:

a wellbore;

a tubing string positioned within the wellbore;

a torque limiter coupled with the tubing string, the torque limiter including:

a tubular housing;

a pipe positioned within the tubular housing;

one or more clutch mechanisms positioned between the pipe and the tubular housing, the one or more clutch mechanisms configured to move between an engaged state to fix the tubular housing relative to the pipe and a disengaged state to allow with the tubular housing to rotate relative to the pipe; and a fluid control system coupled with an exterior of the one or more clutch mechanisms, the fluid control system configured to allow the one or more clutch mechanisms to move from the engaged state to the disengaged state based upon sensing movement of the pipe relative to the tubular housing, wherein the fluid control system includes a hydraulic pump configured to control fluid pressure against the exterior of the one or more clutch mechanisms.

13. The well system according to claim 12, wherein each of the one or more clutch mechanisms includes a piston assembly, wherein the piston assembly is held in the engaged state by fluid pressure against the exterior of the piston assembly.

14. The well system according to claim 12, wherein the hydraulic pump reduces the fluid pressure against the exterior of the one or more clutch mechanisms to allow the one or more clutch mechanisms to move at least partially from the engaged state to the disengaged state.

15. The well system according to claim 12, wherein the hydraulic pump suctions the fluid from the exterior of the one or more clutch mechanisms to move the one or more clutch mechanisms to a substantially disengaged state.

16. The well system according to claim 12, further including:

a pressure relief valve configured to allow fluid from the exterior of the one or more clutch mechanisms to move to a disengaged interior of the of the one or more clutch mechanisms upon failure of the fluid control system and sensing a high-pressure situation; and a one-way check valve configured to allow fluid to move from the disengaged interior of the one or more clutch mechanisms to the exterior of one or more clutch mechanisms when the high-pressure situation has been relieved.

17. The well system according to claim 12, wherein the fluid control system includes electronics configured to sense movement of the pipe relative to the tubular housing and send a signal to a hydraulic pump of the fluid control system to allow the one or more clutch mechanisms to move from the engaged state to the disengaged state.

18. The well system according to claim 12, wherein the wherein the tubing string is a drillstring and wherein the tubular housing includes an upper driver end and a lower driven end, wherein the upper driver end is coupled with the drillstring and fixed with respect to the pipe and the lower driven end engages and disengages with the pipe.

19. A method for limiting torque in a well system, the method comprising:

running a downhole torque limiter into a wellbore, the downhole torque limiter coupled with at least a tubing string and including:

a tubular housing;

a pipe positioned within the tubular housing;

one or more clutch mechanisms positioned between the pipe and the tubular housing, the one or more clutch mechanisms configured to move between an engaged state to fix the tubular housing relative to the pipe and a disengaged state to allow with the tubular housing to rotate relative to the pipe; and a fluid control system coupled with an exterior of the one or more clutch mechanisms, the fluid control system configured to allow the one or more clutch mechanisms to move between the engaged state to the disengaged state;

wherein the fluid control system includes electronics configured to sense movement of the pipe relative to the tubular housing and send a signal to a hydraulic pump of the fluid control system;

sensing movement of the pipe relative to the tubular housing using the electronics;

sending a signal to the hydraulic pump to control fluid against an exterior of the one or more clutch mechanisms; and controlling fluid against the exterior of the one or more clutch mechanisms to allow the one or more clutch mechanisms to move from the engaged state to the disengaged state.

20. The method for limiting torque in a well system according to claim 19, further including a pressure relief valve configured to allow fluid from the exterior of the one or more clutch mechanisms to move to a disengaged interior of the of the one or more clutch mechanisms upon failure of the fluid control system and sensing a high-pressure situation.

21. The method for limiting torque in a well system according to claim 20, further including a one-way check valve configured to allow fluid to move from the disengaged interior of the one or more clutch mechanisms to the exterior of one or more clutch mechanisms when the high-pressure situation has been relieved.

* * * * *